US006796251B2

(12) United States Patent
Martin et al.

(10) Patent No.: US 6,796,251 B2
(45) **Date of Patent: *Sep. 28, 2004**

(54) PROCESS FOR TREATING INCINERATION RESIDUES FROM AN INCINERATION PLANT

(75) Inventors: Johannes Martin, München (DE); Oliver Gohlke, München (DE); Joachim Horn, Dietramszell (DE); Michael Busch, Rosenheim (DE)

(73) Assignees: Martin GmbH Für Umwelt-und Energietechnik, München (DE); Mitsubishi Heavy Industries, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/400,814

(22) Filed: Mar. 27, 2003

(65) Prior Publication Data

US 2003/0183139 A1 Oct. 2, 2003

(30) Foreign Application Priority Data

Mar. 27, 2002 (DE) ..... 102 13 790

(51) Int. Cl.[7] ..... F23J 1/00; F23G 5/00
(52) U.S. Cl. ..... 110/344; 110/346
(58) Field of Search ..... 110/165 A, 165 R, 110/246, 266, 346, 235, 344; 210/195.1; 588/257; 432/16; 75/414, 500; 241/20; 423/210

(56) References Cited

U.S. PATENT DOCUMENTS 3,745,941 A * 7/1973 Reilly ..... 110/346
4,932,336 A * 6/1990 Srowig et al. ..... 110/346
5,671,688 A * 9/1997 Burgin et al. ..... 110/344
6,095,064 A * 8/2000 Millard et al. ..... 110/344
6,145,453 A * 11/2000 Martin et al. ..... 110/346
6,199,492 B1 * 3/2001 Kunstler ..... 110/342
6,309,338 B1 * 10/2001 Christensen ..... 588/257

FOREIGN PATENT DOCUMENTS

DE 701606 * 1/1941
DE 4429958 A1 * 2/1996 ..... F23G/5/00

* cited by examiner

*Primary Examiner*—Kenneth Rinehart
(74) *Attorney, Agent, or Firm*—Cohen, Pontani, Lieberman & Pavane

(57) ABSTRACT

Incineration is controlled in such a way that a sintering and/or fusing of the slag takes place as early as in the incineration bed of the main incineration zone. The incineration residues produced are quenched in a wet slag remover and conveyed out of the latter. The wet incineration residues which come out of the wet slag remover are firstly divided into two fractions by means of a screening operation, after which the main fraction is washed with water taken from the wet slag remover, and in the process adhering fine pieces are separated off. The washed pieces of the incineration residues are fed for reuse. The washing water together with the ultra fine pieces which have been taken up during the washing operation pass into the wet slag remover. The fine fraction produced during the mechanical separation operation is fed back to the incineration operation.

24 Claims, 5 Drawing Sheets

PROCESS FOR TREATING INCINERATION RESIDUES FROM AN INCINERATION PLANT

BACKGROUND OF THE INVENTION

1. Field of the Invention

The invention relates to a process for treating incineration residues from an incineration plant, in particular a waste incineration plant, in which the incineration material is incinerated on a furnace grate, and the incineration residues produced are brought to an elevated temperature by suitably controlling the incineration.

2. Description of the Related Art

In a process of this type, which is known from EP 0 667 490 B1, the incineration material from the furnace grate is heated to such an extent that the slag which is formed in the process is at a temperature which is just below the melting point of this slag before it reaches a melting stage arranged outside the furnace grate. In this process, therefore, the incineration is controlled in such a manner that at the end of the furnace grate the slag is at the highest possible temperature, in order to keep the energy required in the downstream melting stage as low as possible. However, this process does not involve any sintering or melting of the slag. In order nevertheless to obtain the desired slag quality, therefore, a downstream melting stage is required. This downstream melting stage not only requires a suitable device, but also, despite the procedure described above, an increased outlay on energy.

To achieve the desired quality of the slag, the inorganic and organic pollutants constituents which remain from the waste are of importance. Inorganic pollutant constituents which need to be mentioned are in particular heavy metals and salts, while the organic pollutants are attributable in particular to incomplete incineration. For assessment of the quality of the slag, it is also important how the pollutants which are present are washed out in elution tests. Moreover, mechanical properties are of importance in assessing the suitability for construction engineering purposes, e.g. in landfill sites, earthworks or road building.

On account of the high temperatures involved in treating the incineration residues in a melting stage, molten incineration residues are characterized by low levels of organic compounds. While typical slags from waste incineration plants still include unburnt material, usually measured as the loss on ignition, of from 1 to 5% by weight, the loss on ignition of fused incineration residues is less than 0.3% by weight. In addition, fused incineration residues are characterized by low levels of heavy metals and salts which can be leached out, since these are either evaporated or are incorporated in the vitreous matrix which forms when the molten material cools.

SUMMARY OF THE INVENTION

It is an object of the invention to provide a process in which the incineration operation is influenced and controlled in such a way that a fully sintered slag of the desired quality is obtained without using downstream melting or vitrification units, and the drawbacks of dust being formed at the airtight closure of the incineration chamber are avoided with a low level of outlay on equipment, and a low water consumption becomes possible.

The term "fully sintered slag" is understood as meaning a material which consists of sintered and/or fused lumps which typically have a grain size of at least 2 mm to 8 mm. These lumps consist of garbage incineration residues which have been agglomerated by complete or surface fusion.

On account of gases being released during sintering or fusion, the sintered or fused lumps may quite possibly have a porous structure. Any porosity in the fully sintered slag is attributable to the temperature of the molten slag in the incineration bed not being high enough to effect a sufficiently low viscosity and therefore to expel gas bubbles, a technique which in the glass industry is known as refining. In this respect, the fully sintered slag differs from typical vitrified slags which are obtained in downstream high-temperature processes carried out in crucible furnaces lined with refractory material or other melting units.

Moreover, the fully sintered slag may also contain constituents of waste, such as glass or metals, which pass through the furnace grate virtually unaffected by the incineration operation, i.e. in the narrow sense are neither fused nor sintered in the incineration bed, but do have the desired properties in terms of fitting and pollutants which can be leached out.

In accordance with Hammerli (Müll und Abfall 31, Beiheft Entsorgung von Schlacken und sonstigen Reststoffen, [Disposal of slags and other residues supplement], page 142, 1994), the term "sintering" denotes a specific case of fusion and freezing. In the text which follows, therefore, the term sintering goes beyond the use of this term as "superficial fusion of particles to one another or together" which is often customary in scientific fields. The sintered lumps of the fully sintered slag may quite possibly also be completely or partially melted.

In the text which follows, the term residual slag denotes slag constituents which are not sintered and/or fused. Residual slag is characterized by a smaller grain size than that of the fully sintered slag as well as a higher loss on ignition and a higher level of pollutants which can be leached out.

It is known from DE 701 606 C to convey the incineration residues into a slag remover, which has an introduction shoot and a slag removal vessel with rising discharge spout and from there to remove the incineration residues by means of a discharge ram. In the process, the water for quenching the slag is fed to the slag removal vessel, only the same amount of fresh water being introduced into this slag removal vessel as is discharged with the slag on account of its moisture content. In this case, an equilibrium concentration is established with regard to numerous substances and compounds, e.g. salts, which are present in the residues, so that it is impossible to lower their concentration. This results in the slag having unsatisfactory properties with regard to its ability to form landfill and to be processed further to form construction materials. Another reason for this drawback is that there is no division or classification of the incineration residues into fractions with better properties and those with worse properties, and consequently the incineration residues produced as a whole inevitably have unsatisfactory properties.

It is known from DE 44 23 927 A1 to feed the incineration residues which come out of a furnace directly, without prior quenching in a water bath, to the primary cleaning stage. The dry slag which has undergone primary cleaning is separated into at least two fractions. All the particles which are smaller than 2 mm are allocated to a first fraction, and the remaining particles are allocated to a second fraction. As this process continues, the second fraction is in turn separated, in a screening stage, into at least two fractions, and all the particles which are smaller than 27 to 35 mm are allocated to a third fraction, while the remaining particles are allocated to a fourth fraction. In this way, fractions of incineration residues with satisfactory properties are obtained. Drawbacks of this process are the considerable amounts of dust produced and problems with achieving an airtight closure of the incineration chamber.

The object set above is achieved, starting from the process explained in the introduction, in two different ways depending on the composition of the incineration material.

According to the invention, the first way consists in the fact that the incineration is controlled in such a way that sintering and/or fusing of the incineration residues to form slag takes place as early as in the incineration bed of the main incineration zone, that all the incineration residues produced are quenched in a wet slag remover and are conveyed out of the latter, that the wet incineration residues which come out of the wet slag remover are firstly divided into two fractions by means of a mechanical separation operation, after which the main fraction, which substantially includes a coarse fraction and an oversize fraction, is washed with water taken out of the wet slag remover, and in the process adhering finer pieces are separated off, and that the washing water together with the finer parts which it has taken up during the washing operation is fed to the wet slag remover.

This process variant is used whenever it can be assumed that the main fraction to be reutilized contains a low level of pollutants which can be washed out, such as for example salts or heavy metals.

The invention comprises two main areas, one main area lying in the incineration control and the second main area lying in the mechanical treatment of the incineration residues obtained as a result of the incineration operation. This second main area comprises two process variants, which are dependent on the composition of the incineration material.

The first main area is constant for both the following process variants with regard to the mechanical treatment and consists in influencing the incineration operation on the furnace grate in such a way that a sintering and/or fusion operation takes place as early as on the furnace grate in the main incineration zone, and that in each case the as yet unsintered or unfused incineration residues are returned again, in order to undergo the desired sintering and/or fusion operation during the second or third pass.

Therefore, the focal point of the inventive idea consists in the sintering and/or fusion of the incineration residues being carried out as early as in the incineration bed of the main incineration zone, which has hitherto been considered impossible. This is because it is extremely damaging to mechanical furnace grates if liquid slag passes between the individual grate bars or other moveable parts of the furnace grate. For this reason, fusion of the slag on the grate has been avoided, and it has been ensured that the melting point of the slag is not reached in the incineration bed.

In the process according to the invention, the sintering and/or fusion operation takes place in the upper region of the incineration bed, since the maximum action of heat resulting from the radiation of the flame body is introduced from above, while at the bottom the temperature of the material lying directly on the furnace grate can be kept at a lower level, as a result of relatively cold primary incineration air being supplied, than the material at the top of the incineration bed. Since with combustion control of this nature not all the incineration residues produced can be converted into a fully sintered slag of the desired quality, those incineration residues which do not yet have the character of the fully sintered slag are fed back to the incineration operation.

Since the sintering and/or fusion of the slag is achieved in the incineration bed of the grate firing, no additional external energy source is required. The quality obtained as far as possible corresponds to that of the products which the person skilled in the art will recognize from the known downstream high-temperature thermal processes for fusion and vitrification. Equipment such as rotary tubular kilns, crucible furnaces and melting chambers are used. The main drawback of these known processes, however, is the need for the very expensive additional equipment and the high energy consumption, which is avoided by the present invention despite the fact that the quality of the slag remains approximately constant.

In the first process variant with regard to the mechanical treatment, the water originating from the wet slag remover is circulated in such a manner that the main fraction, which has good quality properties, has the adhering fine pieces, which experience has shown have an adverse effect on the quality of the main fraction, removed from it without relatively large quantities of fresh water having to be used, so that the incineration residues are present in the form of slag with good-quality properties for processing.

In the second way of carrying out the process, which is used whenever it is expected that there will be a relatively high level of pollutants which can be washed out, such as for example salts or heavy metals, in the incineration residues produced, the object is achieved by the fact that the incineration is controlled in such a way that sintering and/or fusing of the incineration residues to form slag takes place as early as in the incineration bed of the main incineration zone, that all the incineration residues produced are quenched in a wet slag remover and are conveyed out of the latter, that the wet incineration residues which come out of the wet slag remover are firstly divided into two zones by means of a mechanical separation operation, after which the main fraction which has been separated off and substantially includes a coarse fraction and an oversize fraction if subjected to a comminution operation and is then washed with water taken from the wet slag remover, and that the washing water together with the relatively fine pieces which it has taken up during the washing operation is fed to the wet slag remover. The result of the comminution of the main fraction is that during the subsequent washing operation, the pollutants which are included in the relatively large pieces of the incineration residues are washed out and can in this way be separated from the main fraction which can be reutilized, with the result that, despite these incineration residues being relatively highly laden with pollutants, a large proportion of the incineration residues can be obtained as reusable slag without it being necessary to anticipate relatively large amounts of pollutants being washed out at a later stage.

First of all, the first main area of the invention will be dealt with, this area dealing with incineration control.

A significant advantageous aspect of the incineration control using the process according to the invention consists in the levels of oxygen in the primary incineration air being increased to approx. 25% by volume to 40% by volume. A further advantageous measure consists in the primary air temperature being preheated to levels of approx. 100° C. to 400° C. Depending on the particular conditions, these measures can be used separately or in combination with one another. It is preferable for the incineration bed temperature in the main incineration zone to be set at 1000° C. to 1400° C., depending on the particular condition of the material to be incinerated.

All the measures covered by the incineration control with a view to establishing the desired conditions, in which the incineration residues are converted into sintered and/or fused slag, are selected in such a way that the fully sintered slag forms a proportion of 25–75% by weight of the incineration residues as a whole. This measure ensures that there is sufficient unmelted material on the furnace grate in the incineration bed of the main incineration zone, surrounding the melting slag, so that the latter cannot have any adverse effect on the mechanical parts of the furnace grate.

In an advantageous further configuration of the invention, fly ash is fed back to the incineration operation. This fly ash leaves the incineration bed together with the incineration gases via the steam boiler and is separated out in a downstream off-gas filter.

The following text deals with the second main area covered by the invention, which, in the form of two variants, deals with the mechanical treatment of the incineration residues.

In a further configuration of the invention, the fine fraction and ultra fine fraction produced during the mechanical separation are fed to the incineration operation. These fractions are once again subjected to an incineration operation, so that it is possible to fuse and sinter these fractions.

These measures avoid the drawbacks of the procedure explained first, in which all the incineration residues can only be fed for reutilization if, by chance, the levels of materials with relatively poor properties are low. Compared to the second known process, the drawback of the formation of dust and also the drawback of sealing the incineration chamber are avoided. Moreover, the return of the fine fraction and ultra fine fraction which have relatively poor quality properties additionally increases the proportion of the incineration residues which can be reutilized, since the fine pieces which are returned, after they have been returned one or more times, have the opportunity to agglomerate to form incineration residues which have the desired properties. This advantage is likewise not present in the second known process, on account of the absence of this return step.

If, in a further configuration of the invention, the main fraction which has been prewashed with water from the wet slag remover is rinsed further with fresh water, the slag remover water, which has a relatively high level of pollutants, is rinsed off and the quality of the incineration residues or of the sintered slag is improved further. The use of fresh water to further rinse the coarse fraction also brings the advantage that, as a result, at least some of the water which comes out of the further rinsing stage can be fed to the off-gas purification without this water having to undergo preliminary purification, since the level of pollutants is relatively low. Furthermore, it may be advantageous for at least some of the water which comes out of the further rinse to be fed to the wet slag remover. In this way, the level in the wet slag remover can be maintained, since the quantity of incineration residues discharged always entrains water, with the result that the quantity of water in the wet slag remover decreases and would in any case have to be topped up. Since the water which comes out of the further rinsing stage has only low calcium and sulfate contents, there is no risk of lines or nozzles becoming blocked.

If, in the first separation operation according to the first process variant, the main fraction still contains high levels of an oversized fraction, which usually has a high scrap content, it is possible, in a further configuration of the invention, for the coarse fraction to be subjected to a further mechanical separation operation.

In the text which follows, it is stated, purely by way of example with a view to illustrating the respective ranges and without implying any restriction to the invention, that the ultra fine fraction is to have a grain size of approximately 0 to 2 mm, the fine fraction is to have a grain size of approximately 2 to 8 mm, the coarse fraction is to have a grain size of approximately 8 to 32 mm and the oversized fraction is to have a grain size of approximately over 32 mm. These values are only given to allow an improved understanding as what guidelines; of course, each fraction may contain a certain proportion of the finer fraction below it, provided that the finer constituent is of subordinate importance. It is usual for the fine fraction, which comes directly out of the slag remover and has a grain size of approximately 2–8 mm, to form the proportion of incineration residues which is preferably fed back to the incineration operation. In the second process variant, however, the comminution operation results in the formation of a grain fraction which corresponds to this fine fraction in terms of its grain size distribution but is of a higher standard in terms of its quality for further utilization, and consequently this fine fraction can be referred to as a quality fine fraction.

Therefore, if, for example working on the basis of the first process variant, the first coarse separation maintains a separation limit of 32 mm, i.e. if the oversize fraction has been separated out, it is recommended to provide a second mechanical separation step, which then takes place, for example, at 8 mm, in which all the pieces which are smaller than 8 mm are fed back to the incineration operation.

To prevent mechanical separation devices from being damaged by large pieces of scrap, it is recommended for metals to be separated out from the main fraction.

The main fraction, which comprises an oversize fraction and a coarse fraction, can in this way have not only the large pieces of scrap but also all other metal parts, which are fed for separate utilization, removed from it.

Depending on the procedure and on the intended further utilization of the incineration residues produced, and also depending on the composition of these incineration residues, it may be expedient for metals to be separated off from the oversize fraction and coarse fraction separately from one another.

If, by way of example, the incineration residues are to be used in road building, it is recommended that, after the metals have been separated off, the oversize fraction be subjected to a further comminution operation, since pieces, by way of example, larger than 32 mm are relatively unsuitable for this intended use.

Working on the basis of the first process variant, with a view to providing the largest possible fraction for further utilization, it is expedient if, in a further configuration of the invention, the coarse fraction which has been separated from the main fraction is mixed with the comminuted incineration residues from the oversize comminution step to form a first mixed fraction. In this context, it may prove advantageous for the mixed fraction to be subjected to a mechanical separation operation, since the comminution operation also produces grain sizes which are undesirable for further utilization and which, by way of example, need to be fed back to the incineration operation.

If the incineration residues are to be prepared for a field of application which is of particular interest, namely the production of sub-base layers for road building, it must be possible for the material to be compacted, which is difficult to achieve without a fine fraction which is between 2 and 8 mm according to the coarse division given above. For this reason, it is recommended for some of the coarse fraction to be subjected to a comminution operation, in order to deliberately produce this required fine fraction, so that there is no need to rely on the production of this grain size purely by chance. It is advantageous for approximately 30% of the coarse fraction to be subjected to this comminution operation. The ultra fine fraction and fine fraction which are formed during the comminution of the coarse fraction are mixed with the coarse fraction to form a second mixed fraction. It is preferable for the proportion of the coarse fraction in this mixed fraction which is intended for road building to amount to approximately 70%.

A grain fraction of larger than 8 mm is predominant in this second mixed fraction, since experience has shown that these constituents have the quality required for further utilization, while a smaller proportion of a grain fraction of between 2 and 8 mm is required in order to ensure that these incineration residues can be compacted as mentioned above for the purpose of road building.

If, in a further configuration of the invention, the second mixed fraction is washed with water from the wet slag remover and the ultra fine fraction is separated off, it is ensured that the fractions with the grain size of less than 2 mm, which often contain particularly high levels of pollutants, are separated from the fractions which can be reutilized.

This washing water can advantageously then be fed back to the wet slag remover, as has also been explained above in a different context. The aim and purpose of this return step are in connection with consuming the minimum possible amounts of fresh water.

It is recommended for the metals which have been separated off to be subjected to a wash using water from the slag remover water, so that any remaining incineration residues are washed off.

It is advantageous for a screening operation to be used as a mechanical separation operation.

It is extremely expedient, with a view to increasing the quality of the incineration residues obtained, if precipitating agents for soluble heavy metals are added to the water of the wet slag remover. As a result, these heavy metals can be separated out.

The invention is explained in more detail below with reference to various flow diagrams, which show exemplary embodiments of the process according to the invention.

DETAILED DESCRIPTION OF THE PREFERRED EMBODIMENTS

In accordance with the illustrations shown in the flow diagrams, 1000 kg of garbage with an ash content of 220 kg are added to a grate firing and are incinerated in such a manner that even at this early stage from 25%–75% of the incineration residues produced have been converted into fully sintered slag. During this incineration operation, 800 kg of off-gas and 300 kg of incineration residues are formed. The latter pass into a wet slag remover, from which, on account of the wetting, 315 kg of incineration residues or slag are discharged. These incineration residues are subjected to a mechanical separation step, in the present case to screening at 8 mm. In this step, 215 kg of incineration residues or slag as the main fraction with a grain size of over 8 mm, firstly, and a fine fraction and ultra fine fraction of <8 mm, amounting to 100 kg, are separated from one another. The slag with a grain size of over 8 mm, which comprises a coarse fraction and an oversize fraction, is subjected to a wet treatment, in which, specifically, 1000 liters of water are removed from the wet slag remover, in order to wash this slag and in the process wash off some 15 kg of fine constituents with a size of smaller than 8 mm. This wash can expediently take place on a screen with an underflow size of 8 mm or smaller. The slag water in combination with these fine fractions and ultra fine fractions is fed back to the wet slag remover. The washed slag is removed and taken for utilization, for example in road building. The fine fraction with a mass of approximately 100 kg which was separated off during the screening is usually returned to the grate firing in order to undergo further sintering. However, it is also possible for this fraction to be fed to other treatment processes. 40 liters of feed water or fresh water are supplied, in order to compensate for the water loss in the wet slag remover, which occurs as a result of the incineration residues naturally entraining liquid when they are discharged from the wet slag remover.

Figure 2:
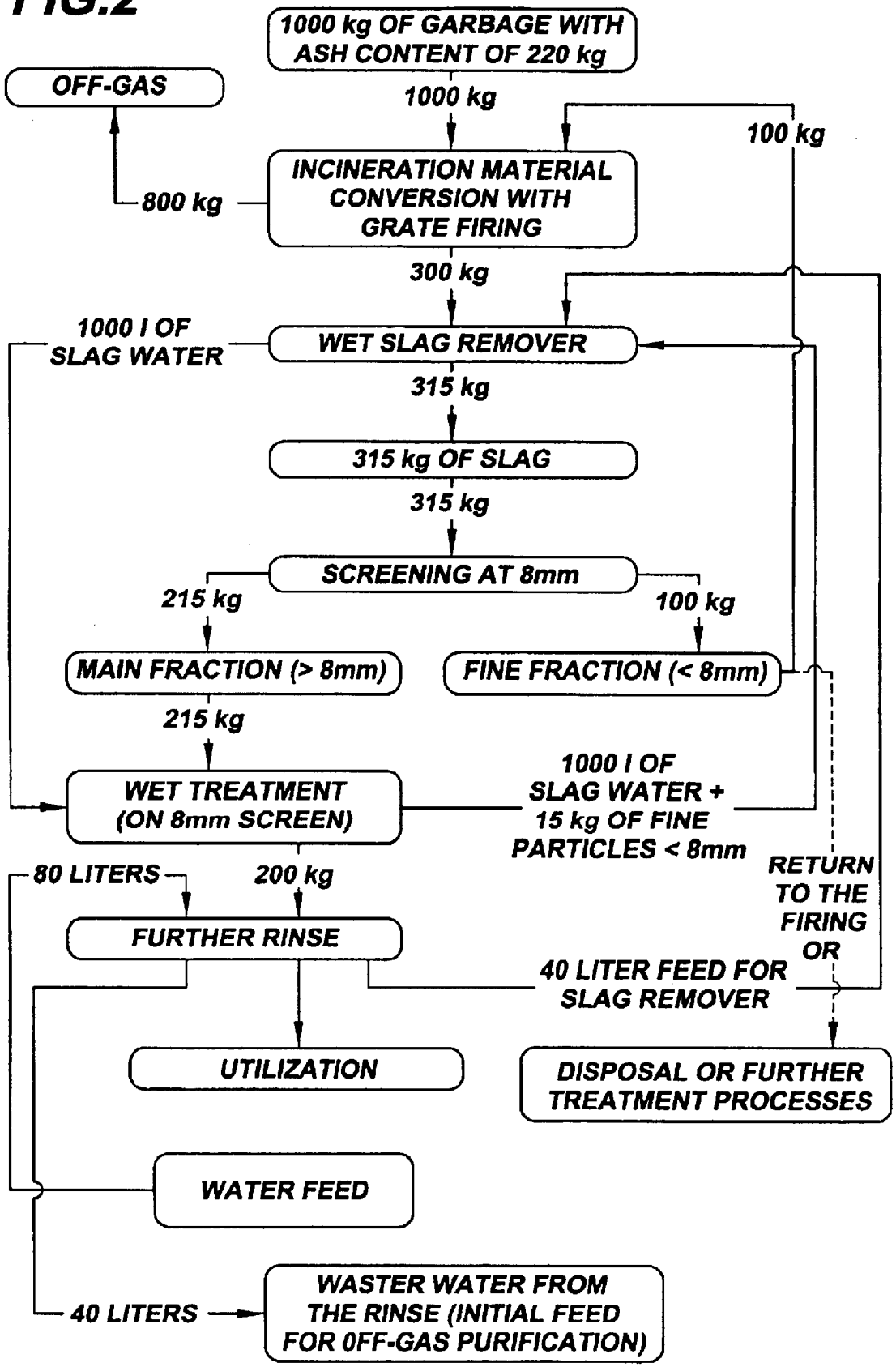
FIG. 2 shows a flow diagram of the basic process with an additional further rinse.

In the modification of the process which is shown in FIG. 2, after the wet treatment of the main fraction with a grain size of over 8 mm, a further rinse is carried out using fresh water, which is added to the 200 kg of the main fraction in an amount of 80 liters, in order to remove adhering constituents which originate from the wet treatment by means of the water from the wet slag remover. 40 liters of this rinsing liquid are branched off for the off-gas purification or disposal in some other way, while a further 40 liters are fed to the wet slag remover to compensate for the water loss. The slag which has been cleaned in this way can be fed for further utilization.

Figure 3:
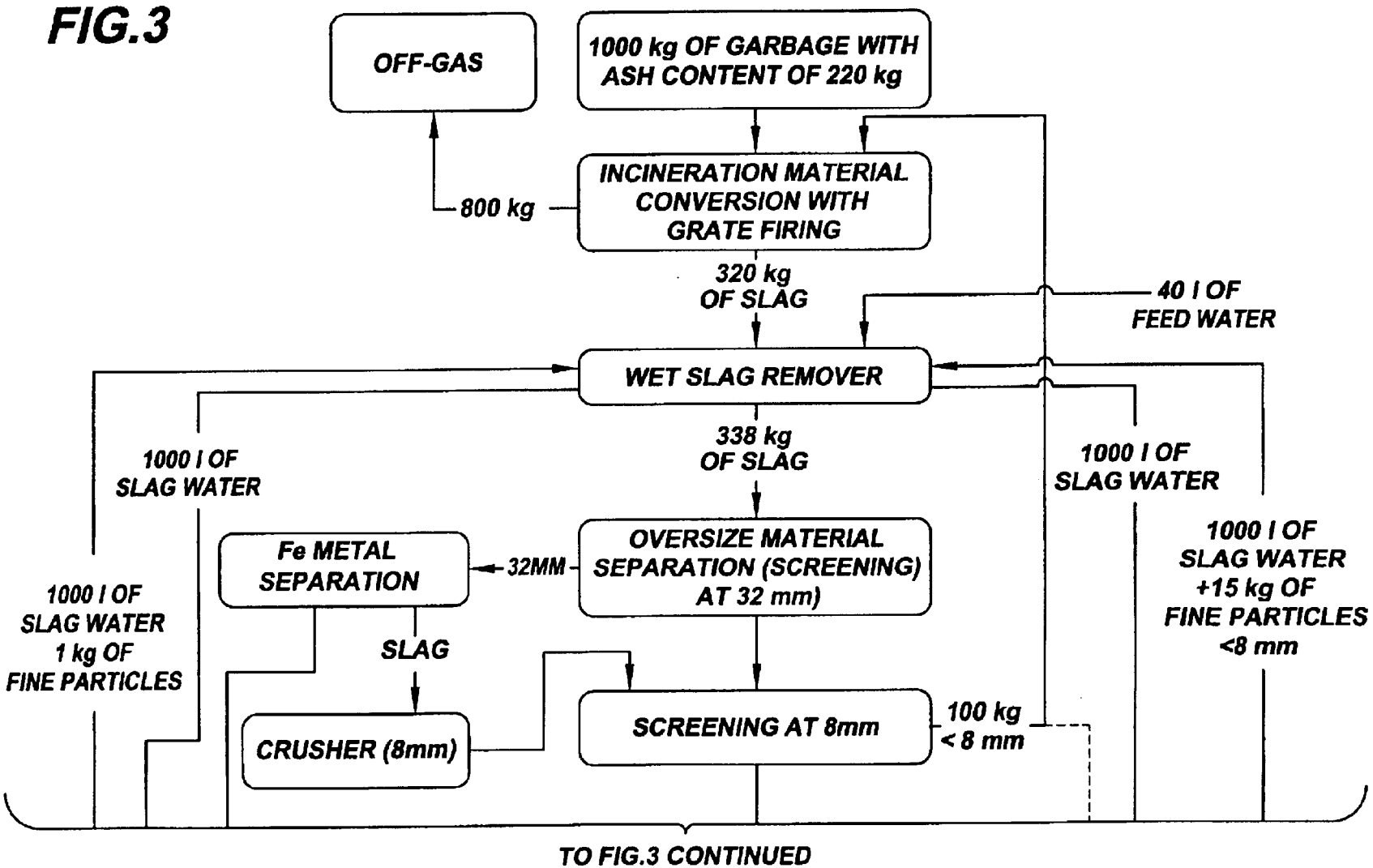
FIG. 3 shows a flow diagram of a variant of the basic process with additional process steps.
Figure 3:
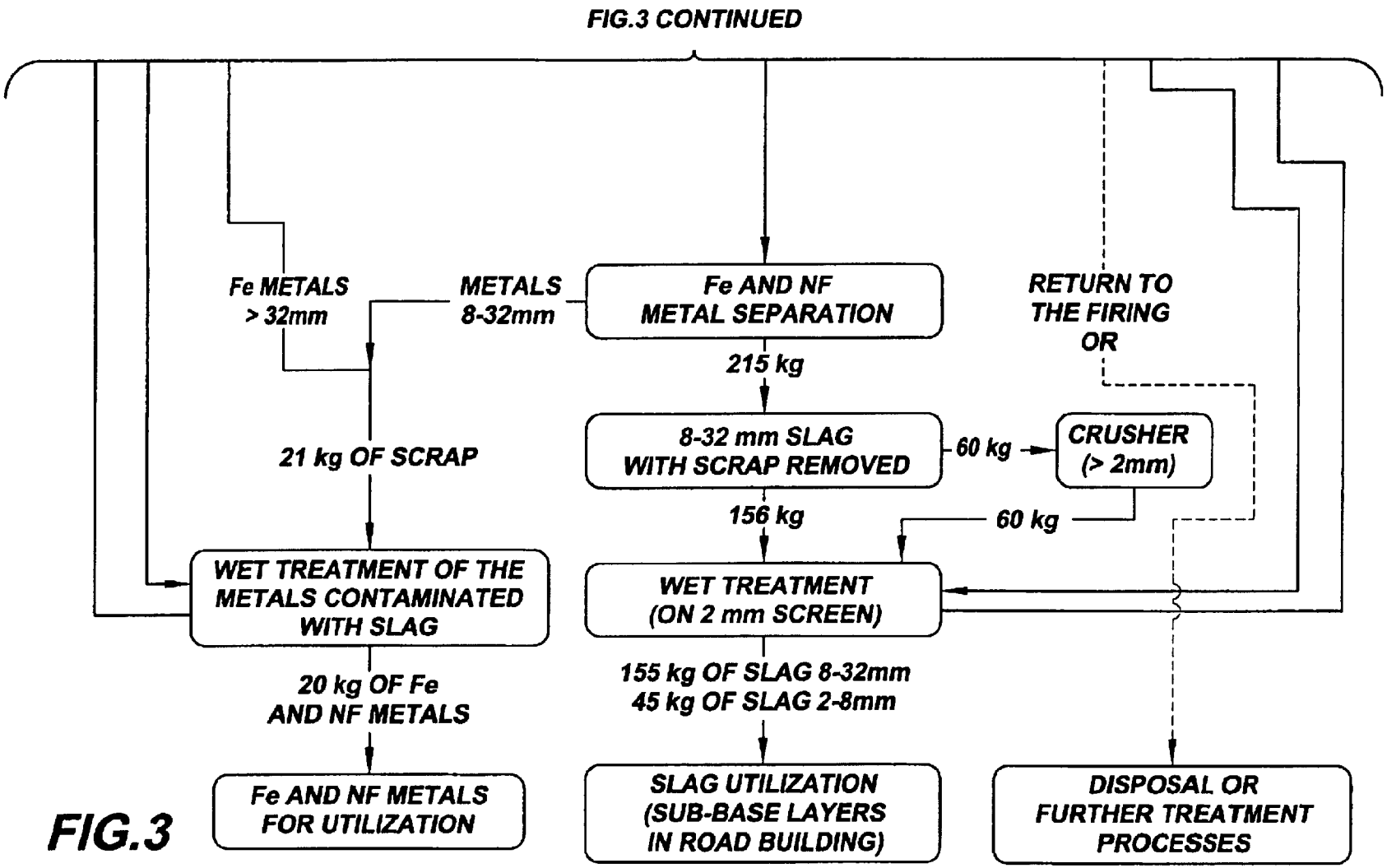

FIG. 3 shows a variant of the process according to the invention. In this altered process, 1000 kg of garbage with an ash content of 220 kg are fed to a grate firing. During the incineration, 800 kg of off-gas and 320 kg of incineration residues, which pass into a wet slag remover, are formed. Around 336 kg of incineration residues are removed from the wet slag remover. The increase in weight results from fine particles which are supplied to the wet slag remover via the recirculation of slag water. 40 liters of water are fed to the wet slag remover to compensate for the water which has been discharged. The 336 kg of slag or incineration residues pass onto a screen with a separation grain size of 32 mm. The oversize fraction with a grain size of >32 mm is first of all fed to a metal separation step. The slag produced in the process passes into a crusher, in order to obtain slag of the order of magnitude of 8 mm. This slag obtained in this way is placed onto a further screen with a separation grain diameter of 8 mm. 100 kg of slag or incineration residues with a grain diameter of <8 mm are removed from this mechanical separation step and are preferably returned to the grate firing stage. The remaining, coarser fraction is passed to a metal separation stage. The pieces of metal obtained and the pieces of metal from the metal separation step from the process step described above are combined and are fed to a wet treatment, in order to rinse off adhering pieces of slag. This step produces 20 kg of ferrous and nonferrous metals, which are fed for utilization. The slag or coarse fraction with a grain size of 8 to 32 mm, from which scrap has been removed, weighs 215 kg. 60 kg of this is fed to a crusher and comminuted to a grain size of >2 mm. After the comminution, the comminuted material is fed to the main stream of 155 kg and subjected to a wet treatment on a screen with a separation grain size of 2 mm. The washing water is removed from the wet slag remover in an amount of 1000 liters. After this wet treatment, 155 kg of slag with a grain size of from 8 to 32 mm and a finer fraction amounting to 45 kg with a grain diameter of 2 to 8 mm are present. These two fractions are fed for further utilization, while fine fractions which have a diameter of less than 2 mm are fed back to the wet slag remover.

Figure 1:
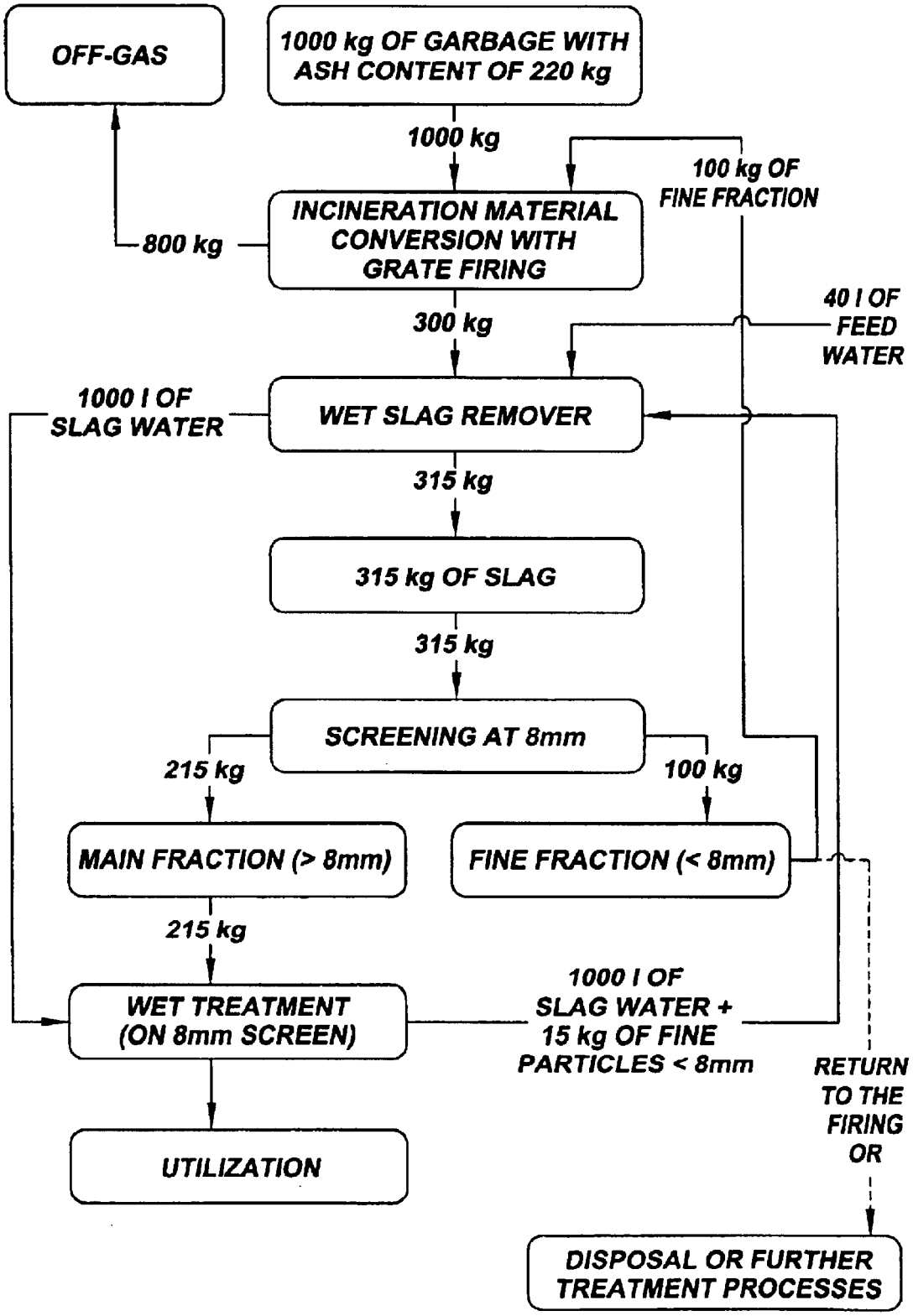
FIG. 1 shows a flow diagram of a basic process.
Figure 4:
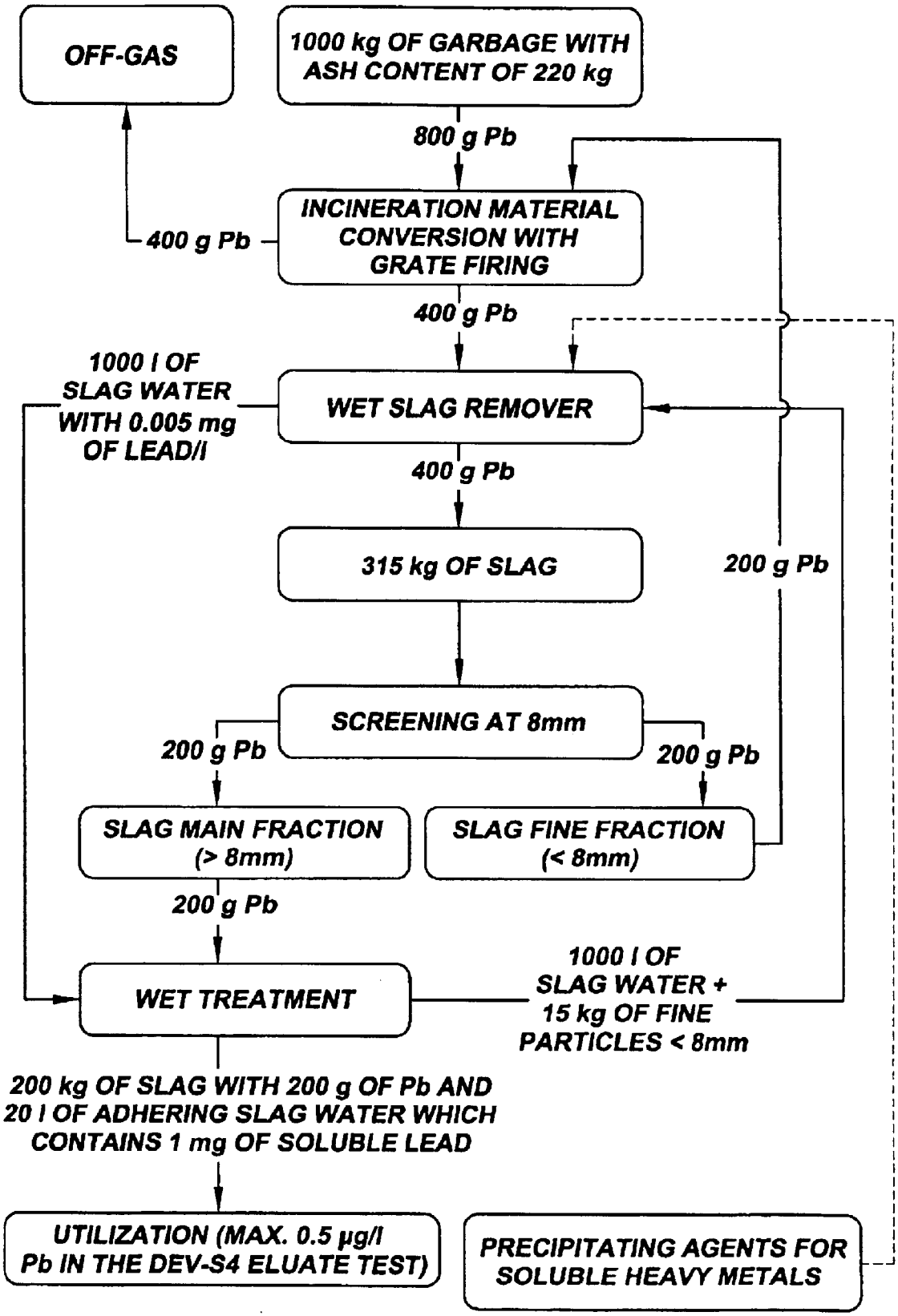
FIG. 4 shows a flow diagram of the basic process with the additional precipitating agents.

The flow diagram shown in FIG. 4 shows the basic variant, corresponding to that shown in FIG. 1, in combination with the addition of a precipitating agent for soluble heavy metals. This precipitating agent is added to the wet slag remover in order to reduce the lead content of the slag remover water from the usual level of 2 mg/l to 0.05 mg/l. As a result, the level of dissolved lead which is present with approx. 20 l of slag water adhering to 200 kg of wet-treated slag is reduced to 1 mg. 400 g of lead is passed into the off-gas during the incineration. During the mechanical separation operation with a separation grain size of 8 mm, the 400 g of lead are divided in such a way that 200 g of lead remains in the slag amounting to 200 kg which is fed for reutilization after the wet treatment, while 200 g of lead are returned to the grate firing with the fine fraction of smaller than 8 mm.

What is claimed is:

1. A process for treating incineration residues from an incineration plant, said process comprising:

introducing incineration material into an incineration zone comprising an incineration bed on a furnace grate;

introducing primary incineration air to said incineration zone from below said furnace grate;

firing said incineration material in said incineration bed to effect incineration of said material to produce incineration residues and fly ash;

controlling said incineration to sinter said incineration residues to form slag in an upper region of said incineration bed in said incineration zone;

incinerating incineration material in an incineration zone on a furnace grate to produce incineration residues and fly ash;

quenching said incineration residues in a wet slag remover;

conveying said residues out of said wet slag remover;

mechanically separating said incineration residues into fractions including a main fraction comprising a coarse fraction and an oversize fraction;

washing said main fraction with washing water taken out of said wet slag remover, thereby separating off finer pieces adhering to said main fraction; and feeding said washing water together with said finer pieces to said wet slag remover.

2. A process as in claim 1 further comprising comminuting said main fraction after separating and prior to washing.

3. A process as in claim 1 wherein said incineration is controlled by maintaining 25% to 40% by volume of oxygen in said primary incineration air.

4. A process as in claim 1 wherein said incineration is controlled by preheating said primary incineration air to 100° C. to 400° C.

5. A process as in claim 1 wherein said incineration is controlled by maintaining said incineration bed at a temperature of 1000° C. to 1400° C.

6. A process as in claim 1 wherein said incineration is controlled so that said incineration residues comprise 25% to 75% frilly sintered slag.

7. A process as in claim 1 wherein said fly ash is fed back to said incineration zone.

8. A process as in claim 1 wherein said mechanically separating further produces a fine fraction and an ultrafine fraction which are fed to said incineration zone.

9. A process as in claim 1 further comprising rinsing said main fraction with fresh rinsing water after washing said main fraction with washing water taken out of said wet slag remover.

10. A process as in claim 9 further comprising feeding at least some of said rinsing water to an off-gas purification after rinsing.

11. A process as in claim 10 further comprising feeding at least some of said rinsing water to the wet slag remover after rinsing.

12. A process as in claim 1 further comprising separating metal from said main fraction.

13. A process as in claim 12 wherein metal is separated from said oversize fraction and said coarse fraction separately.

14. A process as in claim 12 further comprising washing the metals which have been separated out with water from said slag remover.

15. A process as in claim 1 further comprising subjecting said main fraction to a further mechanical separation.

16. A process as in claim 1 further comprising comminuting said oversize fraction.

17. A process as in claim 16 further comprising mixing said coarse fraction with the comminuted oversize fraction to produce a first mixed fraction.

18. A process as in claim 17 further comprising mechanically separating said first mixed fraction.

19. A process as in claim 1 further comprising comminuting said part of said coarse fraction to produce a fine fraction and an ultrafine fraction.

20. A process as in claim 19 wherein said fine fraction and said ultrafine fraction produced by comminuting said coarse fraction are mixed with the coarse fraction to produce a second mixed fraction.

21. A process as in claim 20 further comprising washing said second mixed fraction with water from said slag remover, and separating off said ultrafine fraction.

22. A process as in claim 21 wherein said ultrafine fraction is fed with said washing water to the wet slag remover.

23. A process as in claim 1 wherein said mechanically separating comprises screening.

24. A process as in claim 1 further comprising adding precipitating agents for soluble heavy metals to said washing water.

* * * * *